US008199951B2

(12) United States Patent
Heerlein et al.

(10) Patent No.: US 8,199,951 B2
(45) Date of Patent: Jun. 12, 2012

(54) HEARING AID DEVICE

(75) Inventors: Markus Heerlein, Singapore (SG); Wai Kit Ho, Singapore (SG)

(73) Assignee: Siemens Audiologische Technik GmbH, Erlangen (DE)

( * ) Notice: Subject to any disclaimer, the term of this patent is extended or adjusted under 35 U.S.C. 154(b) by 1201 days.

(21) Appl. No.: 11/922,612

(22) PCT Filed: Jun. 25, 2005

(86) PCT No.: PCT/SG2005/000213

§ 371 (c)(1),
(2), (4) Date: Dec. 20, 2007

(87) PCT Pub. No.: WO2007/001235

PCT Pub. Date: Jan. 4, 2007

(65) Prior Publication Data

US 2009/0110222 A1 Apr. 30, 2009

(51) Int. Cl.
*H04R 25/00* (2006.01)

(52) U.S. Cl. ..... 381/323

(58) Field of Classification Search ..... 381/322–324
See application file for complete search history.

(56) References Cited

U.S. PATENT DOCUMENTS

| | | | |
|---|---|---|---|
| 3,138,491 | A | 6/1964 | Komatsu et al. |
| 4,956,868 | A | 9/1990 | Carlson |
| 5,588,064 | A | 12/1996 | McSwiggen et al. |

FOREIGN PATENT DOCUMENTS

| | | | |
|---|---|---|---|
| DE | 1161599 | B | 1/1964 |
| DE | 3723809 | A1 | 1/1989 |
| DE | 299 16 350 | U1 | 2/2000 |
| EP | 0303143 | A2 | 2/1989 |
| EP | 0 388 501 | A1 | 9/1990 |
| EP | 0388501 | A1 * | 9/1990 |

OTHER PUBLICATIONS

Siemens Internal Communication, Feb. 3, 2012, 1 page.

* cited by examiner

*Primary Examiner* — Elvin G Enad
*Assistant Examiner* — Andrew R Millikin

(57) ABSTRACT

A hearing aid device, including a switch being operable to open and close an electric circuit of the device; and a battery locating means for selectively locating a battery within said device for electrical communication with said electric circuit, wherein the switch inhibits the battery locating means from removing the battery from electrical communication with said electric circuit when the switch is arranged to close the electric circuit.

17 Claims, 13 Drawing Sheets

HEARING AID DEVICE

CROSS REFERENCE TO RELATED APPLICATIONS

This application is the US National Stage of International Application No. PCT/SG2005/000213, filed Jun. 25, 2005 and claims the benefit thereof.

TECHNICAL FIELD OF THE INVENTION

The present invention relates to a hearing aid device. The present invention also relates to a hearing aid switch arrangement for use in a hearing aid device having an electric circuit.

BACKGROUND OF THE INVENTION

Behind-the-ear (BTE) and in-the-ear (ITE) hearing aids typically include operational features such as on/off control, volume control and noise filtration control.

The on/off control feature, for example, has previously been effected by physically connecting and disconnecting a battery to the electric circuit of the hearing aid. A battery compartment door of the hearing aid is typically used to secure the battery inside the hearing aid. When closed, the battery compartment door locates the terminals of the battery in position for electrical communication with the electric circuit, thereby turning the device on. Conversely, the battery compartment door physically remove the battery from the body of the hearing aid, thereby breaking the electrical connection to the circuit, when the door is opened. Otherwise, opening the battery compartment door may simply expose the battery for removal from the device. It may not always be convenient to close and open the battery compartment doors of a hearing aid to switch the device on and off.

A disadvantage of switching off the hearing aid device in the above-described manner is that the battery is exposed to the elements and may deteriorate faster than it would have done so if it was located within the device. In addition, there is a risk that the battery may be dislodged from the device and lost.

It is generally desirable to overcome or ameliorate one or more of the above mentioned difficulties, or at least provide a useful alternative.

SUMMARY OF THE INVENTION

In accordance with one aspect of the present invention, there is provided a hearing aid device, including:

(a) a switch being operable to open and close an electric circuit of the device; and (b) a battery locating means for selectively locating a battery within said device for electrical communication with said electric circuit, wherein the battery locating means inhibits the removal of the battery from electrical communication with said electric circuit when the switch is arranged to close the electric circuit.

Preferably, the battery locating means permits access to the battery for removal of the battery from the device when the switch is arranged to open the electric circuit.

Preferably, the battery locating means is adapted to move the battery with respect the electric circuit to thereby connect and isolate the battery to and from the electric circuit.

Preferably, said switch is in mechanically coupled to said battery locating means.

In accordance with another aspect of the present invention, there is provided a hearing aid switch arrangement for use in a hearing aid device having an electric circuit, the hearing aid switch arrangement including:

(a) an activation switch being operable to open and close the electric circuit of the device; and (b) a battery locating means for selectively locating a battery within said device for electrical communication with said electric circuit, wherein the battery locating means inhibits the removal of the battery from electrical communication with said electric circuit when the switch is arranged to close the electric circuit.

Preferably, the battery locating means permits access to the battery for removal of the battery from the device when the switch is arranged to open the electric circuit.

Preferably, the battery locating means is adapted to move the battery with respect the electric circuit to thereby connect and isolate the battery to and from the electric circuit.

Preferably, said activation switch is in mechanically coupled to said battery locating means.

BRIEF DESCRIPTION OF THE DRAWINGS

Preferred embodiments of the present invention are hereafter described, by way of non-limiting example only, with reference to the accompanying drawing in which.

DETAILED DESCRIPTION OF PREFERRED EMBODIMENTS OF THE INVENTION

Figure 1:
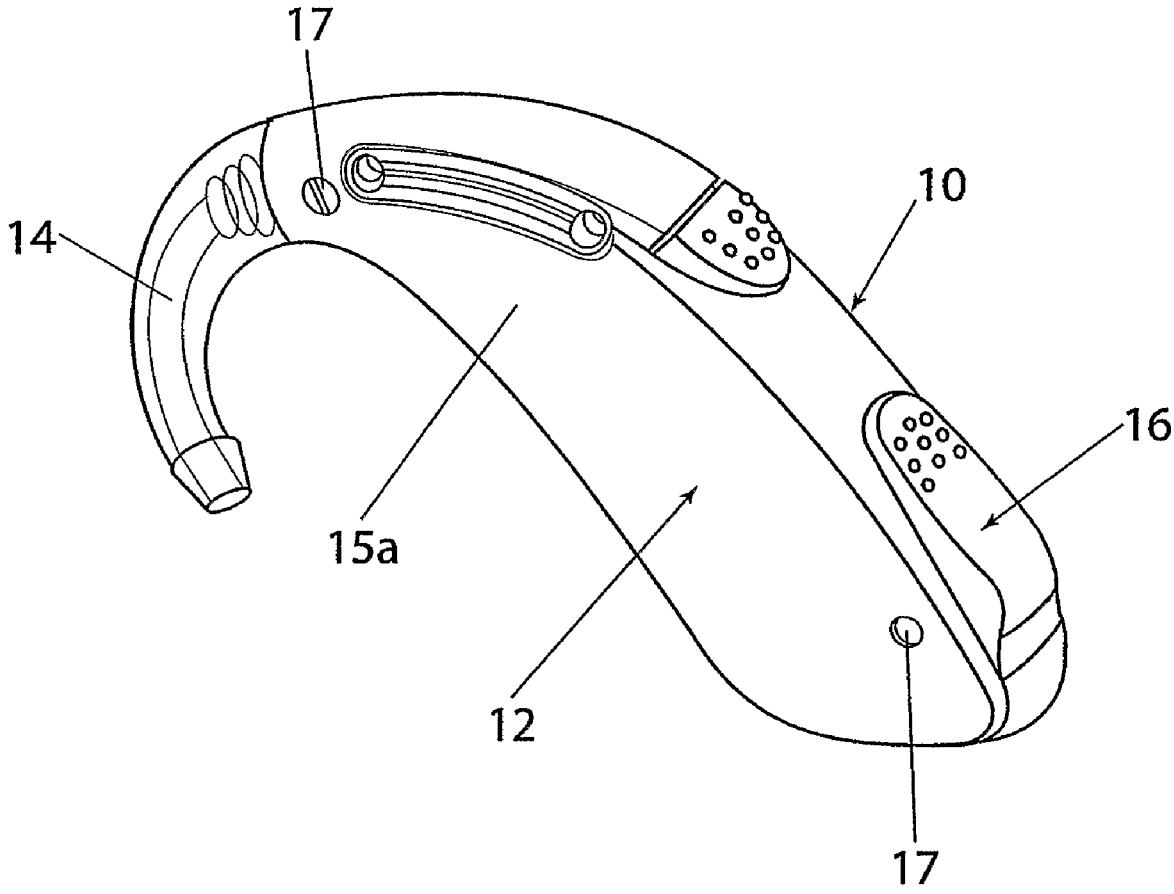
FIG. 1 is a perspective view of a hearing aid device in accordance with a preferred embodiment of the invention.

The behind-the-ear (BTE) hearing aid device 10 shown in FIG. 1 includes a housing 12 coupled to a hook 14. The housing 12 is formed in two shells 15*a*,15*b* (only 15*a* shown in FIG. 1) that are fastened together by screws 17. The housing 12 is shaped to fit behind the ear of a person and encases many of the internal components of the hearing aid 12. The hook 14 is coupled to an end of the housing 12 and is shaped to extend into the ear of a person wearing the device 10. Preferred embodiments of the invention are hereafter described by way of reference to the BTE hearing aid 10. However, it would be understood by those skilled in the relevant art that the invention is applicable to any one of a number of different types of hearing aid devices.

The hearing aid device 10 includes a switch 16 that is used to turn the hearing aid 10 on and off. The switch 16 includes an on/off cover 18 mechanically coupled to a battery compartment door 20 in the manner shown in FIGS. 2 to 4. The on/off cover 18 is rotatable about an axle 26 so as to move between on and off positions that respectively complete and break, ie close and open, an electric circuit 22. The battery compartment door 20 is coupled to the housing 12 by a hinge that facilitates movement of the door 20 between open and closed positions with respect to the housing 12. The door 20 includes a cradle 23 that is shaped to receive a battery 24. The battery 24 can be loaded into, or removed from, the cradle 23 when the door 20 has been opened. The cradle 23 locates the battery within the housing 12 for electrical connection with the electric circuit 22 when the door 20 is closed. The mechanical connection between the on/off cover 18 and the battery compartment door 20 prevents the door 20 from being opened when the on/off cover 18 is arranged in the on position. The on/off cover 18 thereby prevents the battery 24 from being removed from the device 10 when the cover 18 is arranged in the on position.

Figure 5:
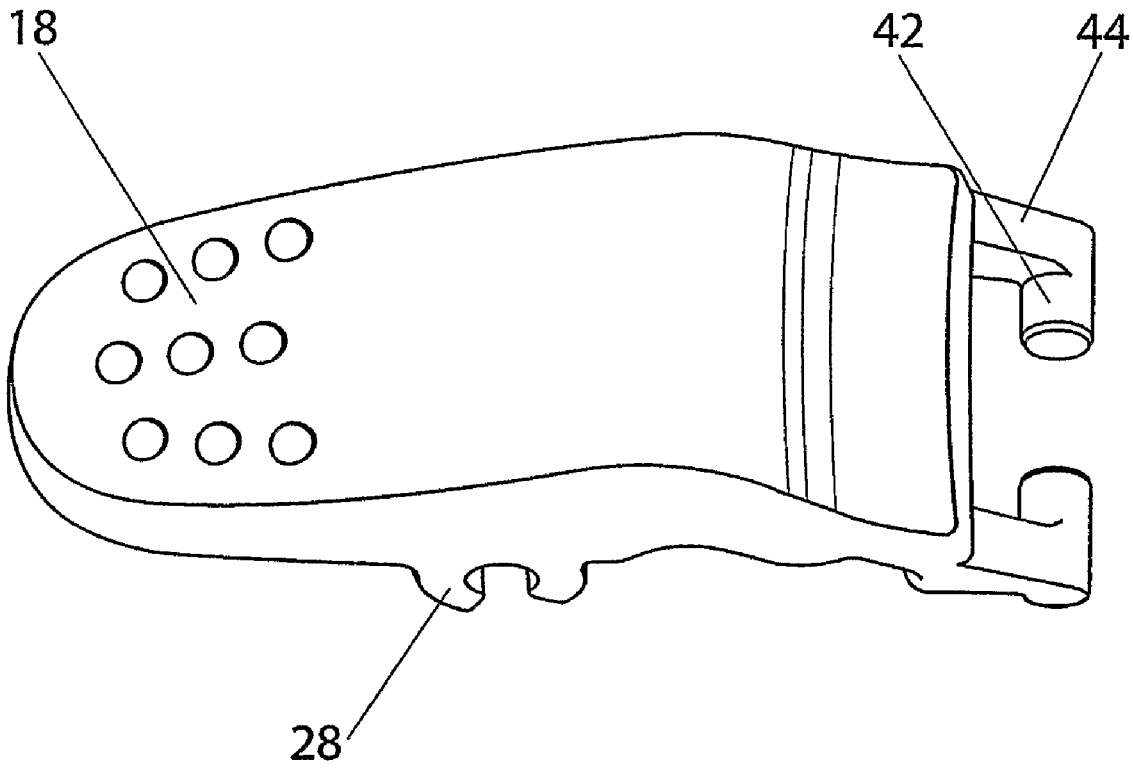
FIG. 5 is a perspective view of a part of the hearing aid shown in FIG. 1.

The on/off cover 18, also shown in FIG. 5, is removably attached to the housing 12 by way of the axle 26. The axle 26 bridges a gap between opposed internal sidewalls of the two shells 15*a*,15*b* of the housing 12. The opposed internal sidewalls include recesses shaped to receive respective ends of the axle 26 and thereby hold the axle 26 in position. The on/off cover 18 is coupled to, and is adapted to rotate about an axle 26 by way of a clasp 28. The clasp 28 permits the on/off cover to be removably attached to the axle 26. The clasp 28 is made of a resilient material, such as Acrylonitrile Butadiene Styrene (ABS), that permits the clasp 28 to snapped onto the axle 26 with the application of a suitable force.

Figure 6:
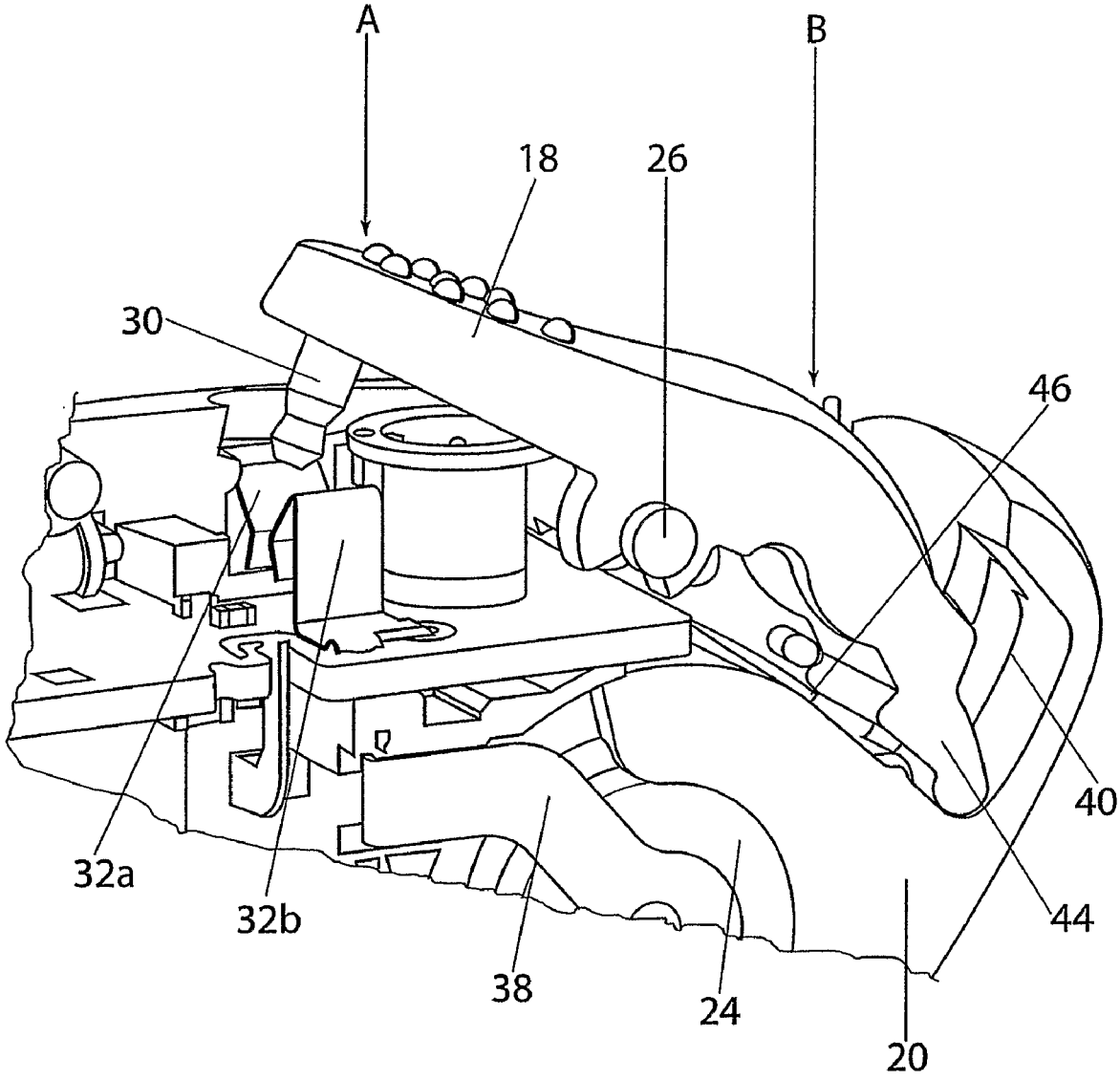
FIG. 6 is a view of yet another section of the hearing aid device shown in FIG. 1 with part of the housing removed so as to show the internal parts of the device.
Figure 7:
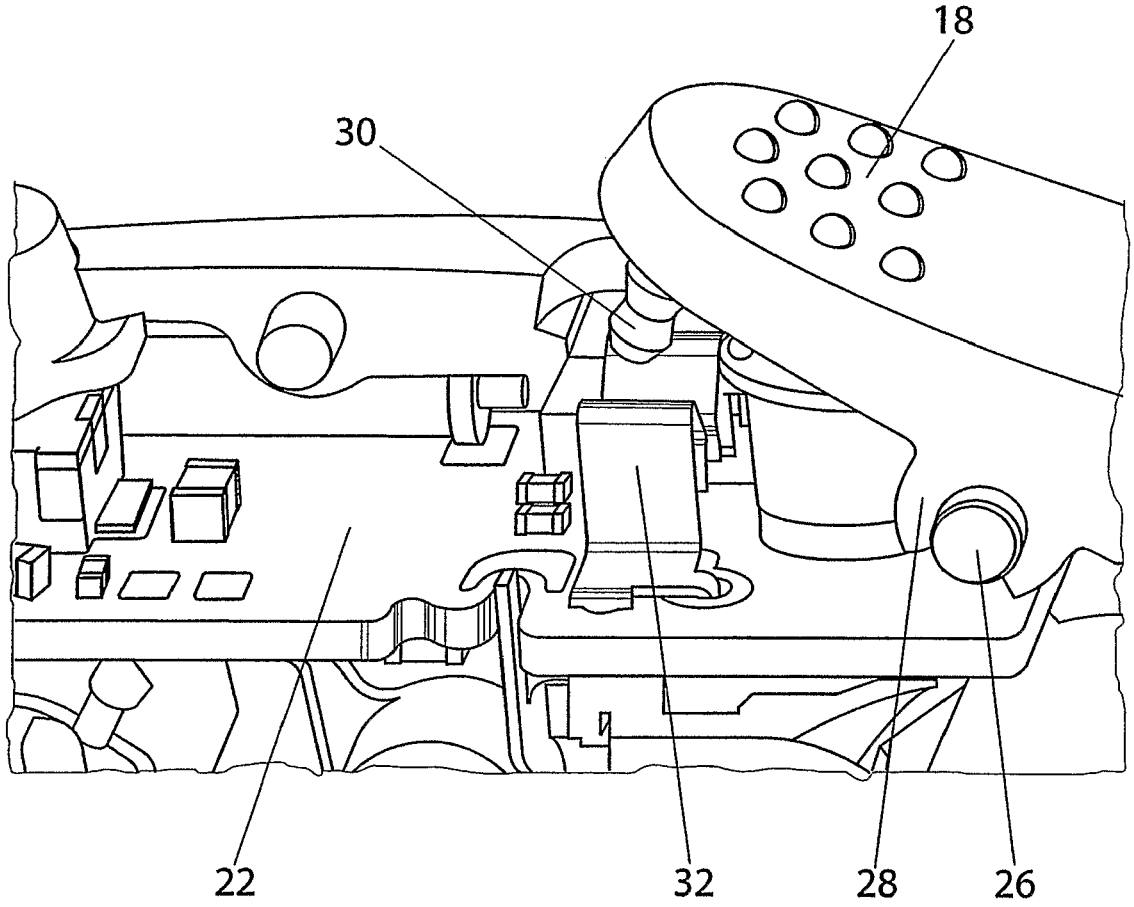
FIG. 7 is a view of another section of the hearing aid device shown in FIG. 1 with part g removed so as to show the internal parts of the device.

The switch 16 includes male and female electrically conductive contact elements 30,32 secured to the on/off cover 18 and the electric circuit 22 respectively in the manner shown in FIGS. 6 and 7. The female contact element 32 includes first and second parallel, spaced apart, resilient conductive lugs 32*a*,32*b* that project outwardly from the electric circuit 22. Distal ends of the contacts 32*a*,32*b* include opposed flanges that each extend towards the other lug 32*a*,32*b*. The flanges are spaced apart and define a socket that is shaped to receive the male contact element 30.

When a force is applied to the on/off cover in direction B, the on/off cover 18 rotates about the axle 26 and the male contact element 30 moves away from the female contact element 32. In doing so, the lugs 32*a*,32*b* of the female contact element 32 are electrically isolated and the electric circuit 22 is switched off. When so arranged the on/off cover 18 is in the off position. When a force is applied to the on/off cover 18 in direction A, the on/off cover 18 rotates about the axle 26 and the male contact element 30 moves towards the female contact element 32. In doing so the male contact element 30 is located between the resilient lugs 32*a*,32*b* and bears against the respective flanges. The flanges resiliently deform and engage the male contact element 30. The flanges interlock with corresponding waisted sections of the male contact element 30 and thereby secure the on/off cover 18 in the on position. Alternatively, the flanges secure the male contact element therebetween by any other suitable means. The male contact element 30 thereby closes the circuit 22

Figure 8:
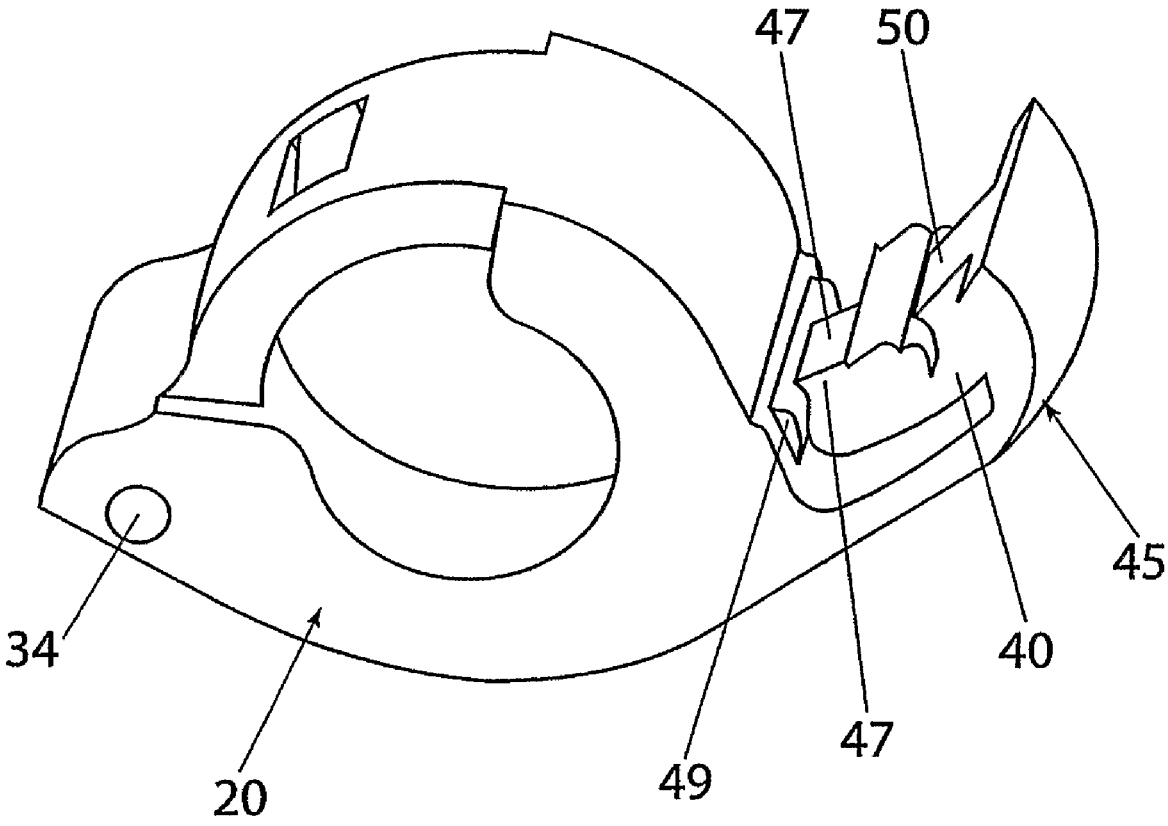
FIG. 8 is a perspective view of another part of the hearing aid shown in FIG. 1.
Figure 9:
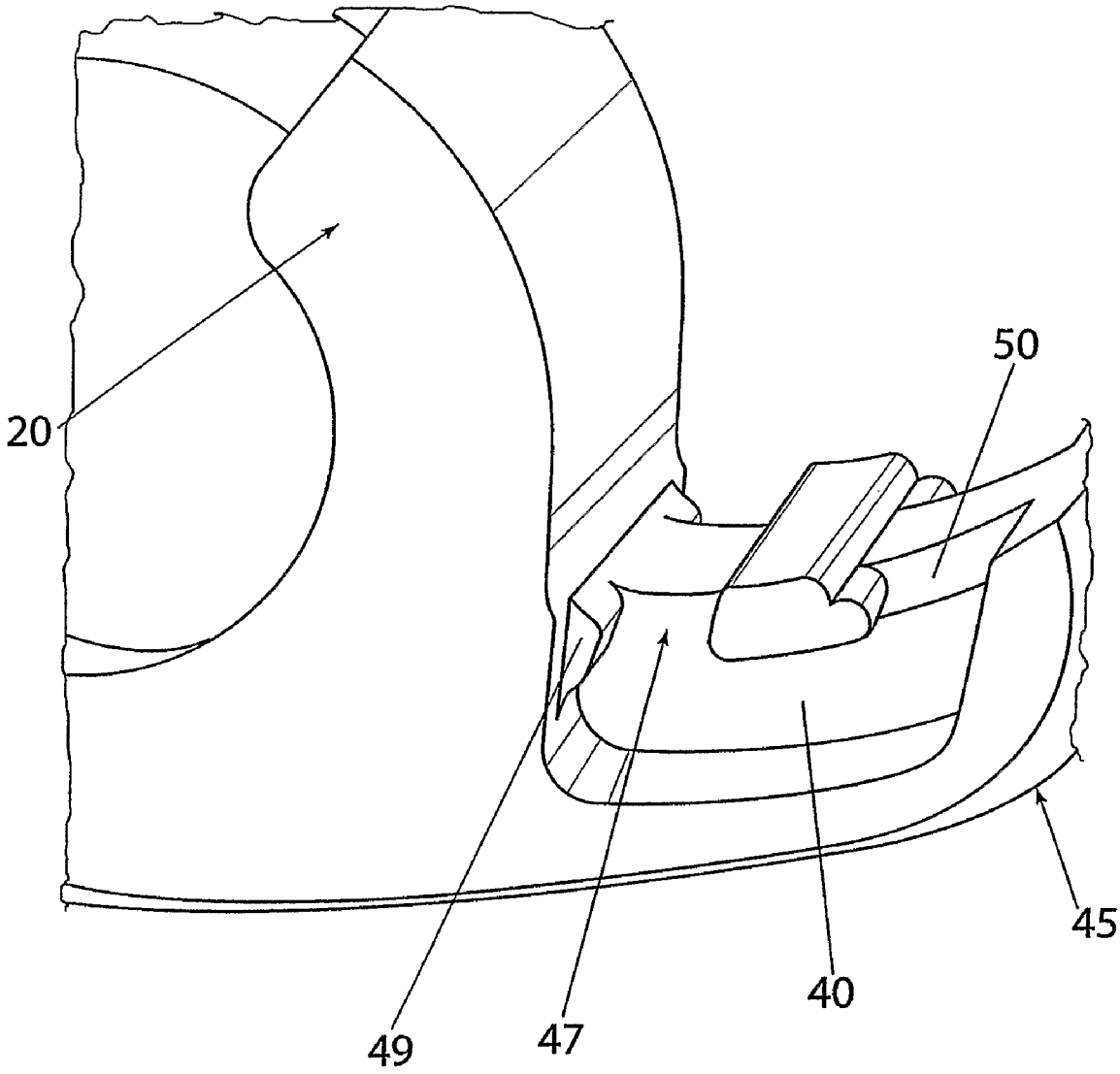
FIG. 9 is another perspective view of a part of the hearing aid device shown in FIG. 8.

The battery compartment door 20, also shown in FIGS. 8 and 9, includes a hole 34 that is shaped to receive the axle 25. The axle 25 is thereby removably and rotatably couplable to the door 20 of the housing 12. As above described, the battery compartment door 20 includes a cradle 23 that is shaped to receive the battery 24 and the door 20 locates the battery 24 in position for electrical connection to the electric circuit 22 when the door 20 is closed. The electric circuit 22 includes first and second electrically conductive contacts 38 (only one of which is shown in the drawings) that are arranged to engage respective oppositely charged terminals of the battery 24. The battery is electrically coupled to the circuit 22 when the door 20 is closed. The battery compartment door 20 removes the battery 24 from electrical communication with the electric circuit 22 when the door 20 is opened.

As also above described, the on/off cover 18 and the battery compartment door 20 are mechanically coupled together such that the battery compartment door 20 cannot be readily opened unless the on/off cover 18 is first arranged in the off position. The battery compartment door 20 includes first and second grooves 40 (only one of which is shown in the drawings) located on opposite sides of the door 20 for receiving corresponding pins 42 of the on/off cover 18. The pins 42 extend inwardly from respective distal ends of arms 44 that extend from opposite sides of a common end of the on/off cover 18. A locking section 45 of the door 20 is arranged between the arms 44. The arms 44 straddle the locking section 45 and locate the inwardly extending pins 42 in the respective corresponding grooves 40 of the locking section 45.

Figure 2:
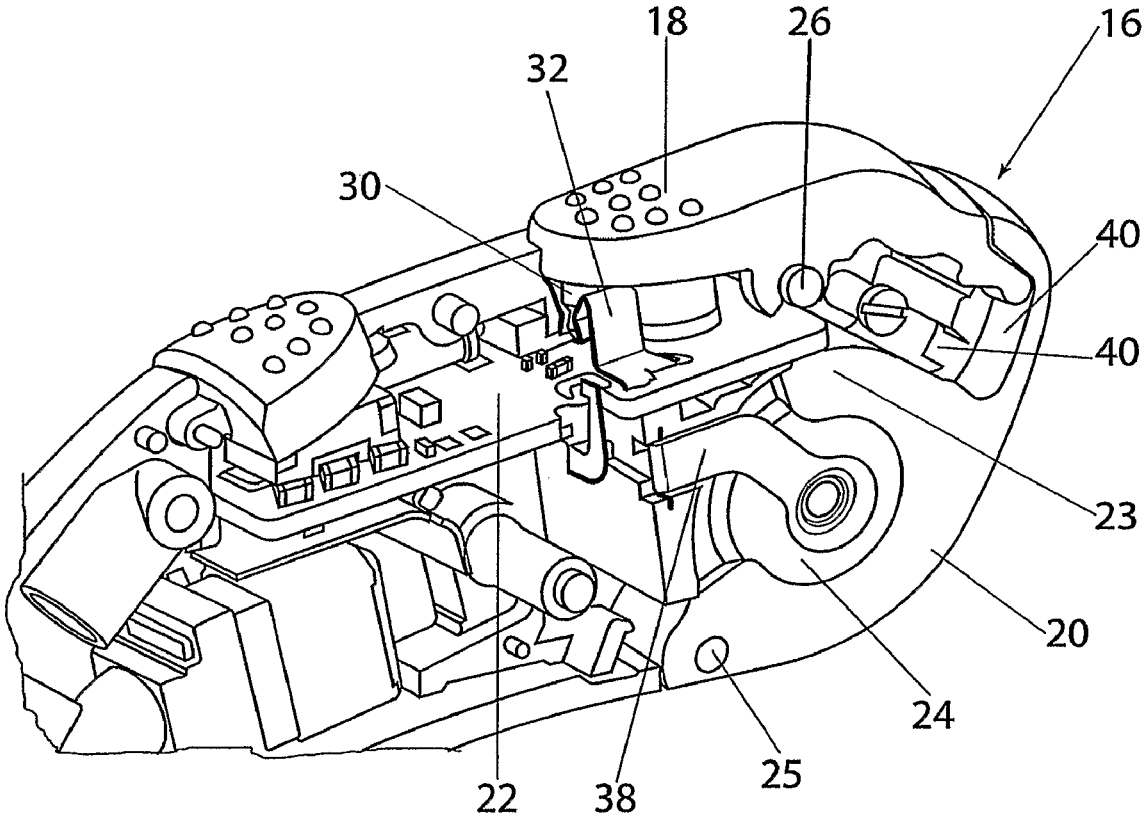
FIG. 2 is a view of a section of the hearing aid device shown in FIG. 1 with part of the housing removed so as to show the internal parts of the device.
Figure 3:
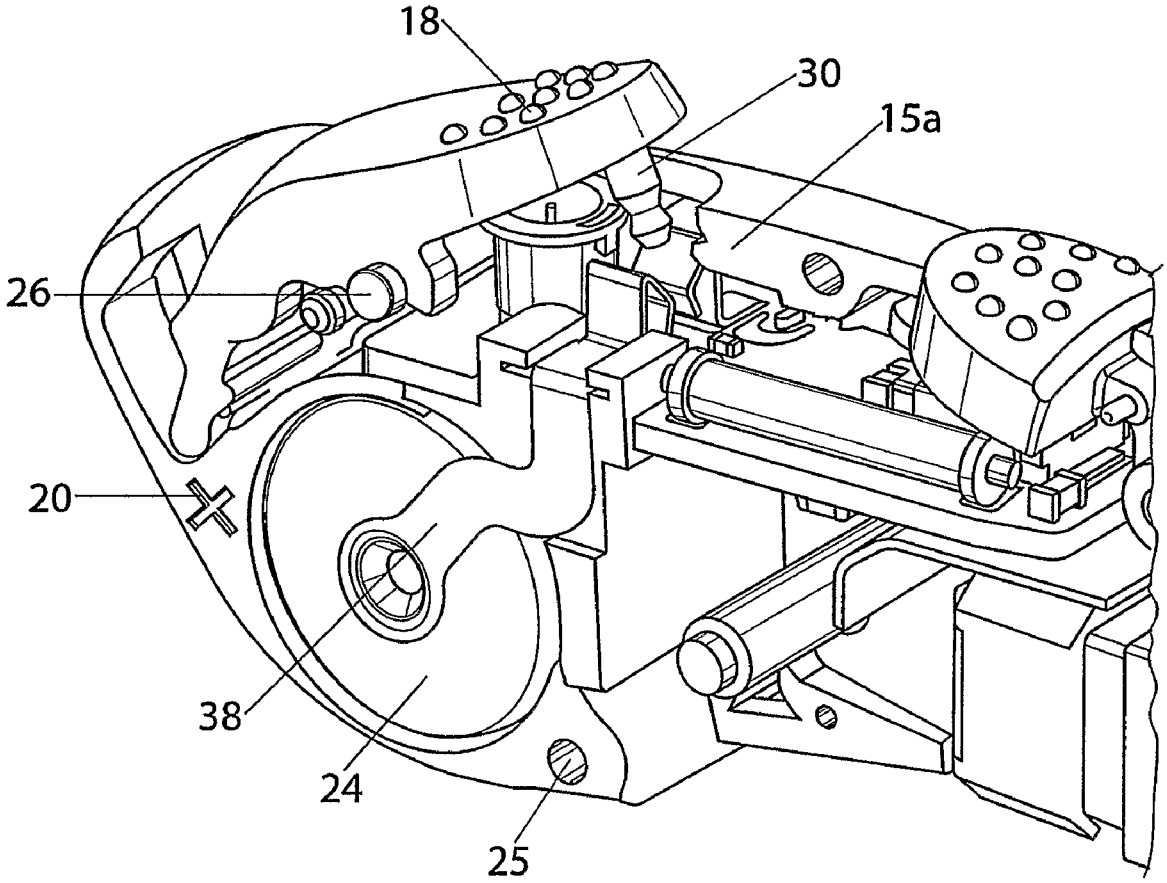
FIG. 3 is a view of another section of the hearing aid device shown in FIG. 1 with part of the housing removed so as to show the internal parts of the device.

The pins 42 slidably engage the grooves 40 such that when a force is applied to the on/off cover 18 in direction B, the on/off cover 18 rotates about the axle 26 and the pins 42 slide along the grooves 40, as shown in FIG. 6. Similarly, when a force is applied to the on/off cover 18 in direction A, the on/off cover 18 rotates about the axle 26 and the pins 42 slide along the groove 40, as shown in FIG. 2.

Figure 4:
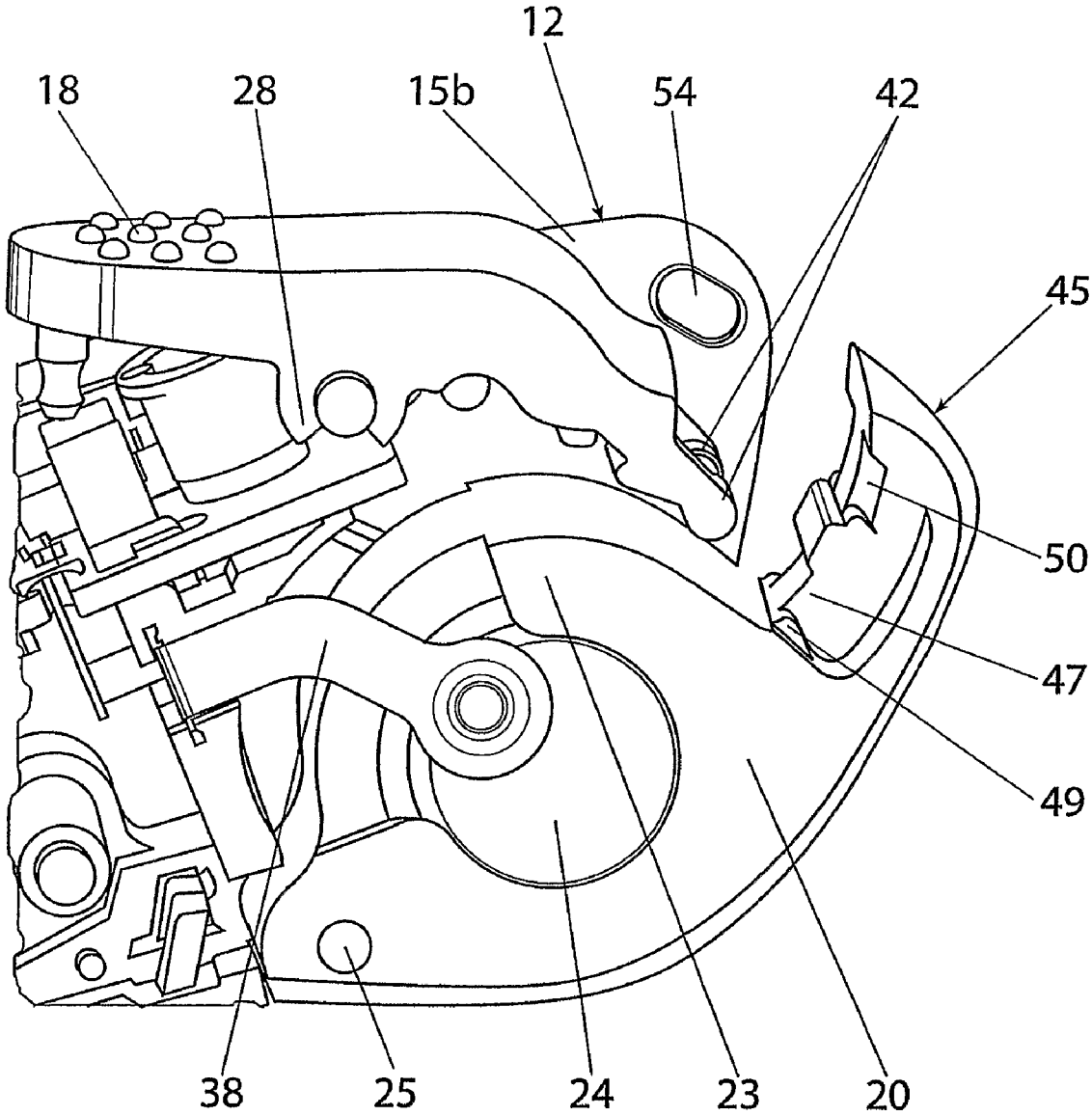
FIG. 4 is a view of yet another section of the hearing aid device shown in FIG. 1 with part of the housing removed so as to show the internal parts of the device.

Corresponding ends of the grooves 40 include openings 47 through which the corresponding pins 42 of the cover 18 can pass into and out of the grooves 40. For example, the on/off cover 18 can be disconnected from the battery compartment door 20 by arranging the on/off cover in the off position, as shown in FIG. 6, and then drawing the pins 42 of the cover 18 through openings 47, as shown in FIG. 4. In doing so, the battery compartment door 20 is free to rotate about the axle 25 away from the housing 12 towards an open position. The openings 47 of the grooves 40 are each narrowed by respective shoulders 49 which reduce the ease by which the pins 42 of the cover 18 can pass there through. The shoulders 49 prevent the battery compartment door 20 from freely rotating about the axle 25 when the cover 18 is arranged in the off position. With a little effort a person can force the pins 42 of the cover 18 through the openings 47 and thereby open the battery door 20.

The on/off cover 18 is coupled to the door 20 by locating the pins 42 in the grooves 40 by forcing the pins 42 through respective openings 47 in the manner shown in FIGS. 4 and 6. The diameter of the two openings 47 of the groove 40 is slightly narrower than the diameter of the pins 42 such that the pins 42 can only be fitted into and disengaged from the groove 40 if a suitable force is used. The on/off cover 18 and the door 20 are decoupled by arranging the on/off cover 18 in the off position and then forcing the pins 42 through the openings 47.

The following steps are performed to remove the battery from the device 10:

1. Arrange the on/off cover 18 in the off position;
2. Decouple the on/off cover 18 and the housing in the described manner;
3. Pivot the door 20 away from the housing 12; and
4. Remove the battery 24.

The above steps are performed in reverse order to locate the battery within the housing for electrical connection to the circuit 22.

Figure 10:
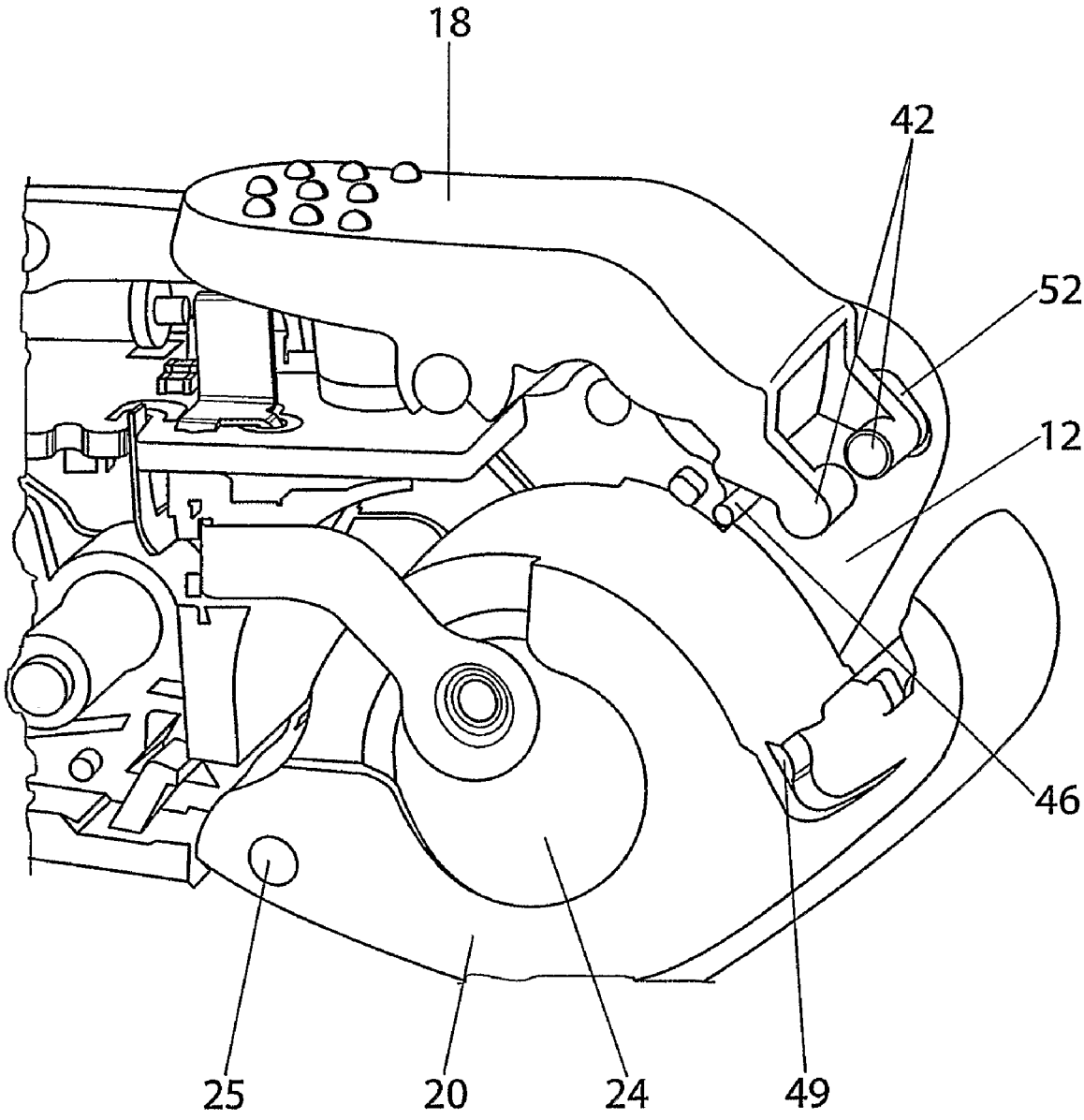
FIG. 10 is a view of another section of the hearing aid device shown in FIG. 1 with part of the housing removed so as to show the internal parts of the device.
Figure 11:
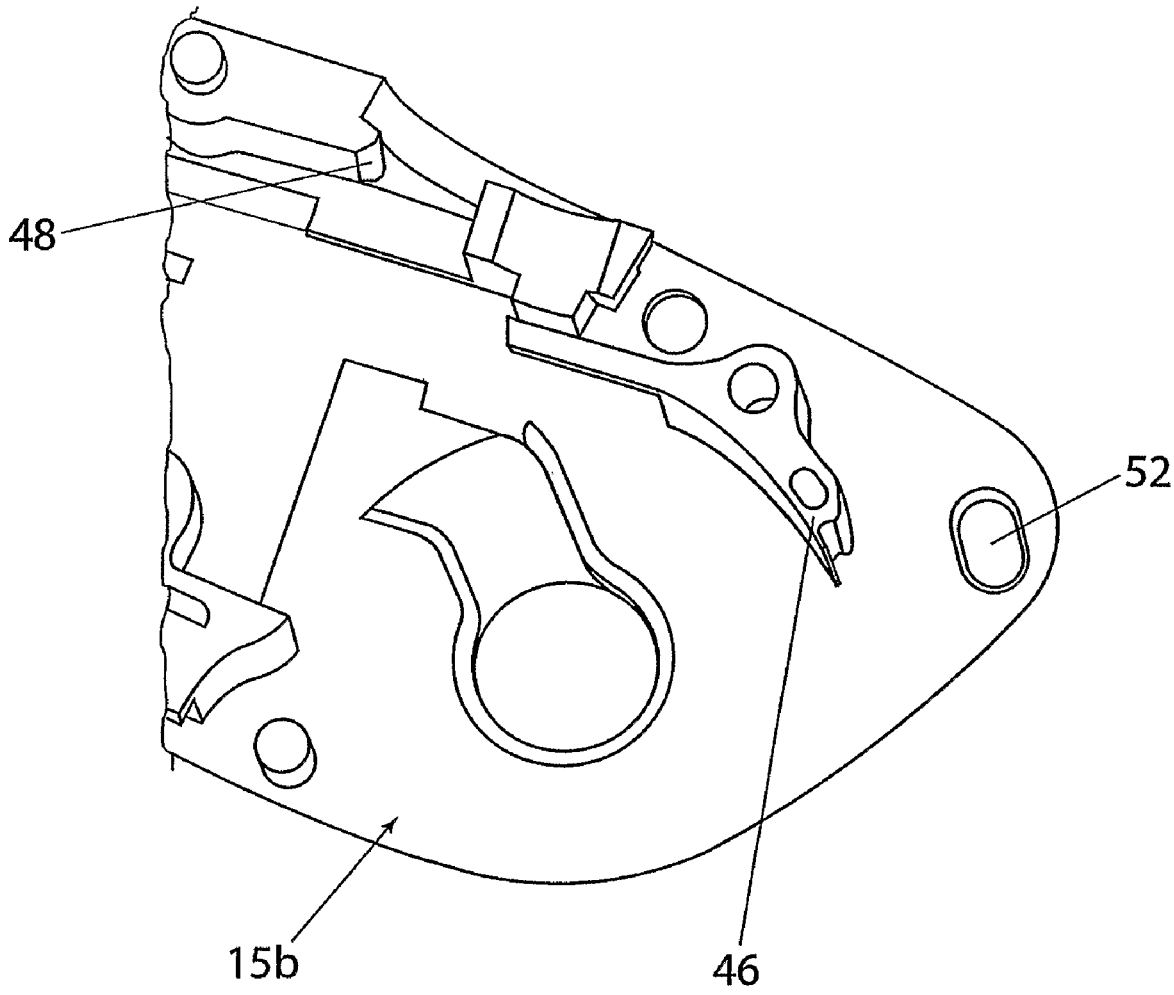
FIG. 11 is a view of an internal side of a part of the hearing aid shown in FIG. 1.

The inner side of the one of each one of the shells 15*a*,15*b* of the housing 12 includes a stopper 46 in the form of a protruding ledge, shown in FIGS. 10 and 11. The stopper 46 is arranged to limit rotation of the on/off cover 18 in one direction. The housing 12 includes a further stopper 48 is arranged to limit rotation of the on/off cover 18 in the opposite direction.

Figure 12:
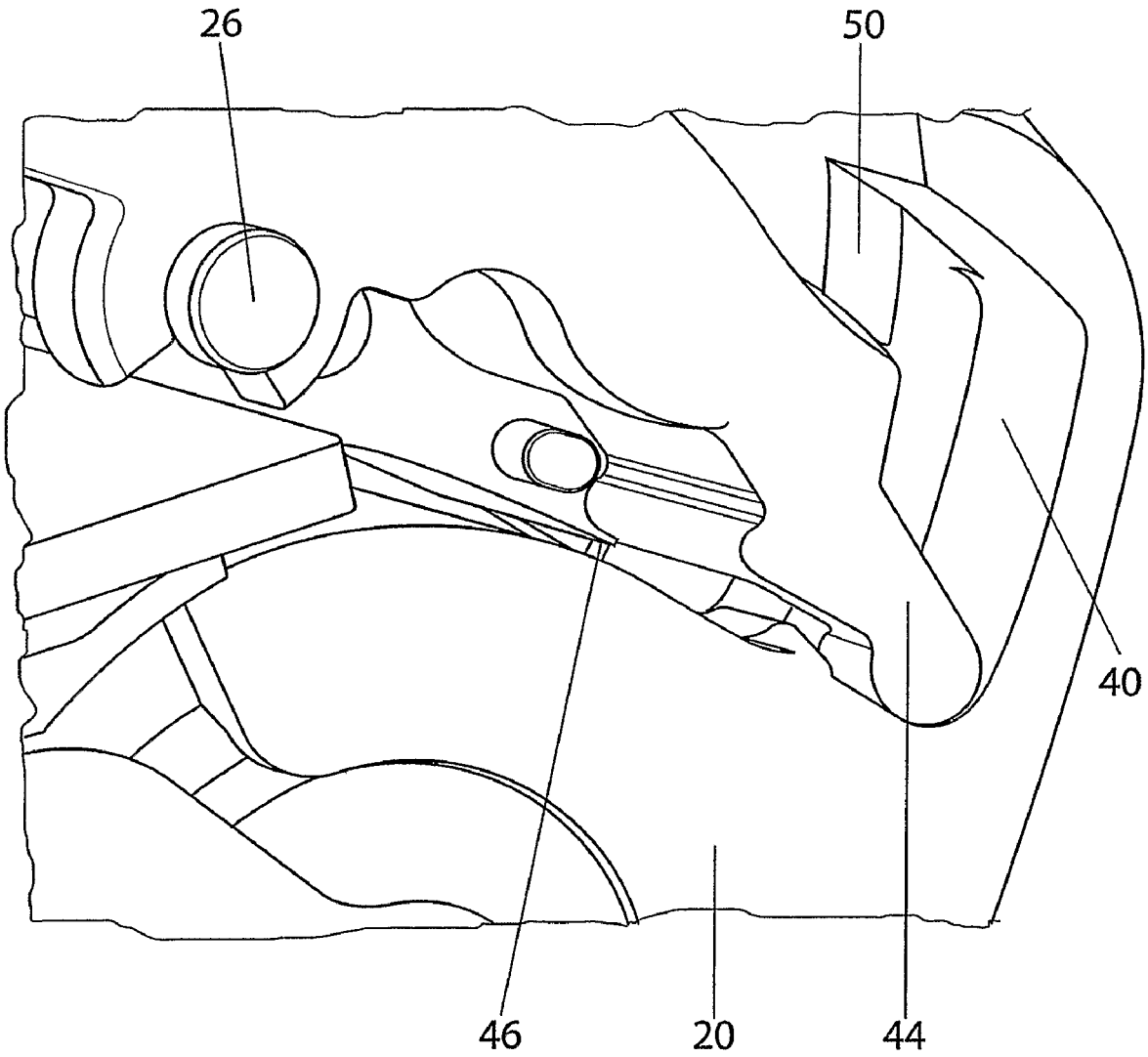
FIG. 12 is a view of yet another section of the hearing aid device shown in FIG. 1 with part of the housing removed so as to show the internal parts of the device.

The locking section 45 further includes chamfer surfaces 50, as shown in FIG. 12, over which the pins 42 may also be located in the grooves 40. The chamfer surfaces 50 are located at an opposite ends of the grooves to the above described openings 47. The pins are located in the grooves 40 by arranging the on/off cover 18 in the closed position and forcing the pins 42 into the grooves 40 through the chamfer section 50. The chamfer surfaces 50 are tapered and thus help to guide the pins 42 into position. The internal side of both shells 15*a*,15*b* of the housing 12 are provided with respective recesses 52 to allow the pins 42 to flex outwards when they are fitted into the groove 40 in such a situation.

Figure 13:
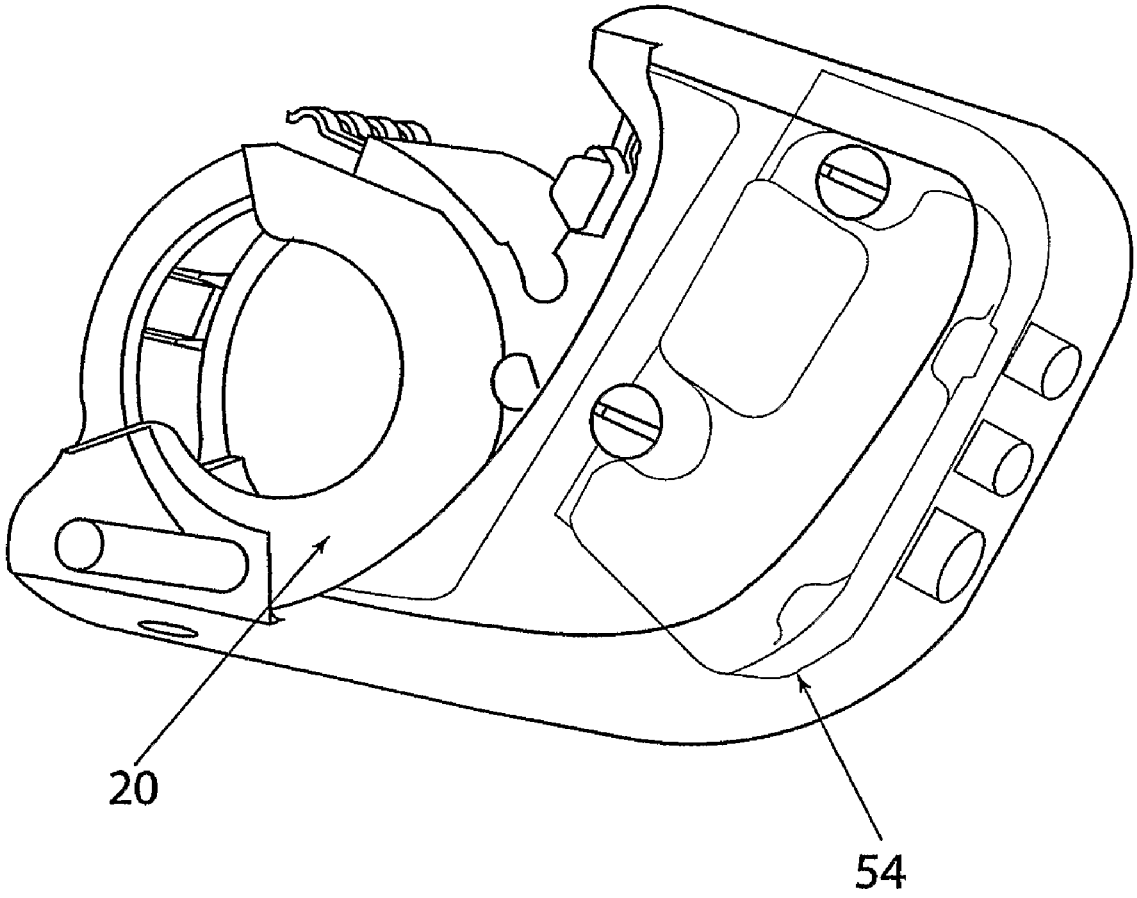
FIG. 13 is a perspective view of the battery compartment of the hearing aid integrated with an audio device.

The battery compartment door 20 can be replaced with one that integrates an audio device 54 suitable for say FM frequency reception, as shown in FIG. 13. The on/off cover 18 would still be compatible with the replacement battery compartment door 20.

The various components are injection moulded from plastic material such as Acrylonitrile Butadiene Styrene (ABS).

While we have shown and described specific embodiments of the present invention, further modifications and improvements will occur to those skilled in the art. We desire it to be understood, therefore, that this invention is not limited to the particular forms shown and we intend in the append claims to cover all modifications that do not depart from the spirit and scope of this invention.

The invention claimed is:

1. A hearing aid device, comprising:

a housing;

a switch that opens and closes an electric circuit of the hearing aid device; and a battery door that selectively locates a battery within the housing for electrical communication with the electric circuit and inhibits removing the battery from the electrical communication with the electric circuit when the switch closes the electric circuit, wherein the switch comprises an on/off cover that is rotatable about an axle to move between on and off positions for closing and opening the electric circuit respectively, and wherein the switch comprises male and female electrically conductive contact elements secured to the on/off cover and the electric circuit respectively.

2. The hearing aid device claimed in claim 1, wherein the battery door permits an access to the battery for removing the battery from the hearing aid device when the on/off cover is in the off position.

3. The hearing aid device claimed in claim 1, wherein the battery door moves the battery with respect to the electric circuit to connect and isolate the battery to and from the electric circuit.

4. The hearing aid device claimed in claim 1, wherein the on/off cover is mechanically coupled to the battery door to prevent the door from being opened when the on/off cover is in the on position.

5. The hearing aid device claimed in claim 1, wherein the on/off cover pivots about a body portion of the hearing aid device to open and close the electric circuit.

6. The hearing aid device claimed in claim 1, wherein the on/off cover is decouplable from the battery door when the on/off cover is in the off position.

7. The hearing aid device claimed in claim 6, wherein the on/off cover comprises a first pin and a second pin that extend into corresponding grooves of the battery door and the first and the second pins slidably engage the first and the second grooves in accordance with a movement of the on/off cover.

8. The hearing aid device claimed in claim 7, wherein the grooves comprise openings located at a common end that facilitate insertion and removal of the first and the second pins into and from the grooves.

9. The hearing aid device claimed in claim 1, wherein the on/off cover is in the off position when the male electrically conductive contact element moves away from the female electrically conductive contact element, and wherein the on/off cover is in the on position when the male electrically conductive contact element moves toward the female electrically conductive contact element.

10. A hearing aid switch for a hearing aid device, comprising:

a housing;

an activation switch that opens and closes an electric circuit of the hearing aid device; and a battery door that selectively locates a battery within the housing for electrical communication with the electric circuit and inhibits removing the battery from the electrical communication with the electric circuit when the switch closes the electric circuit, wherein the activation switch comprises an on/off cover that is rotatable about an axle to move between on and off positions for closing and opening the electric circuit respectively, and wherein the activation switch comprises male and female electrically conductive contact elements secured to the on/off cover and the electric circuit respectively.

11. The hearing aid switch as claimed in claim 10, wherein the battery door permits an access to the battery for removing the battery from the hearing aid device when the on/off cover is in the off position.

12. The hearing aid switch as claimed in claim 10, wherein the battery door moves the battery with respect to the electric circuit to connect and isolate the battery to and from the electric circuit.

13. The hearing aid switch as claimed in claim 10, wherein the on/off cover is mechanically coupled to the battery door to prevent the door from being opened when the on/off cover is in the on position.

14. The hearing aid switch as claimed in claim 10, wherein the on/off cover pivots about a body portion of the hearing aid device to open and close the electric circuit.

15. The hearing aid switch as claimed in claim 10, wherein the on/off cover is decouplable from the battery door when the on/off cover is in the off position.

16. The hearing aid switch as claimed in claim 15, wherein the on/off cover comprises a first pin and a second pin that extend into corresponding grooves of the battery door and the first and the second pins slidably engage the first and the second grooves in accordance with a movement of the on/off cover.

17. The hearing aid switch as claimed in claim 16, wherein the grooves comprise openings located at a common end that facilitate insertion and removal of the first and the second pins into and from the grooves.

* * * * *